US006572241B1

(12) United States Patent
Chan et al.

(10) Patent No.: US 6,572,241 B1
(45) Date of Patent: Jun. 3, 2003

(54) COLOR WASH LIGHT

(75) Inventors: Arnold Chan, London (GB); Jonathan Coles, London (GB)

(73) Assignee: Isometrix Lighting & Design Limited, London (GB)

( * ) Notice: Subject to any disclaimer, the term of this patent is extended or adjusted under 35 U.S.C. 154(b) by 0 days.

(21) Appl. No.: 09/719,897

(22) PCT Filed: Jun. 15, 1999

(86) PCT No.: PCT/GB99/01890

§ 371 (c)(1),
(2), (4) Date: Mar. 26, 2001

(87) PCT Pub. No.: WO99/66257

PCT Pub. Date: Dec. 23, 1999

(30) Foreign Application Priority Data

Jun. 17, 1998 (GB) ..... 9813063

(51) Int. Cl.[7] ..... F21V 9/00

(52) U.S. Cl. ..... 362/231; 362/230; 362/246; 362/244; 362/293; 362/339

(58) Field of Search ..... 362/230, 231, 362/244, 245, 246, 247, 295, 251, 293, 330, 339

(56) References Cited

U.S. PATENT DOCUMENTS

| | | | | | |
|---|---|---|---|---|---|
| 1,811,084 | A | * | 6/1931 | Holmqvist | 362/245 |
| 3,868,671 | A | * | 2/1975 | Maguire et al. | 340/323 |
| 5,803,579 | A | * | 9/1998 | Turnbul et al. | 362/83.1 |

FOREIGN PATENT DOCUMENTS

| | | |
|---|---|---|
| DE | 3709025 | 11/1987 |
| DE | 29620583 | 2/1997 |
| EP | 0242422 | 10/1987 |
| EP | 0684421 | 11/1994 |

* cited by examiner

*Primary Examiner*—Sandra O'Shea
*Assistant Examiner*—Bertrand Zeade
(74) *Attorney, Agent, or Firm*—Flynn, Thiel, Boutell & Tanis, P.C.

(57) ABSTRACT

A lighting system comprises a plurality of adjacent light sources of different colors. Each light source has a wide angle beam in a first plane and a narrower angled beam in a substantial perpendicular second plane. As a result, efficient mixing of light is achieved in the first plane.

21 Claims, 7 Drawing Sheets

COLOR WASH LIGHT

FIELD OF INVENTION

This invention relates to the mixing of a plurality of electronically controlled light sources which are filtered to produce specific colours and then mixed to make any one of a range of colours including, with appropriate filtering, any colour in the visual spectrum.

BACKGROUND OF THE INVENTION

Systems for mixing red, green and blue coloured light to produce other colours has long been used to produce colour television pictures. However, in the area of direct lighting the larger the light sources and high powers involved have made it difficult to produce beams of light with homogenous colour. This difficulty arises because of the relatively large size of light sources and the fact that a compromise has to be made between effective colour mixing and efficient beams of light. Colour mixing can be best achieved by diffusing the light whilst efficient beams of light are produced by focusing the light.

SUMMARY OF THE INVENTION

A preferred embodiment of the present invention overcomes these problems by creating a wide angle mixing beam in one plane of illumination whilst maintaining a narrow beam in a substantially perpendicular plane. Using such a system makes it possible to illuminate a surface with uniformly colored light of any colour in the spectrum using apparatus containing only three suitably filtered light sources.

A further preferred embodiment of the invention uses semi specular or linear prismatic reflectors combined with small viewing shields to minimize the colour mixing zone and obscure it from view. This allows lighting units embodying the invention to be mounted within low height ceiling voids thus greatly enhancing the number of applications to which they can be put.

In a further preferred embodiment the surface being illuminated has its base inclined towards the viewer.

Preferably, a single action user interface is incorporated which may be a rotary knob or a slider with a purpose made colour scale that defines a set number of colours or change cycles to enable the user to turn the knob or slide the slider to a given colour and that colour will appear.

BRIEF DESCRIPTION OF THE DRAWINGS

The invention is defined in the appended claims to which reference should now be made.

A preferred embodiment of the invention will now be described in detail by way of example with reference to the accompanying drawings which.

DETAILED DESCRIPTION

Figure 1:
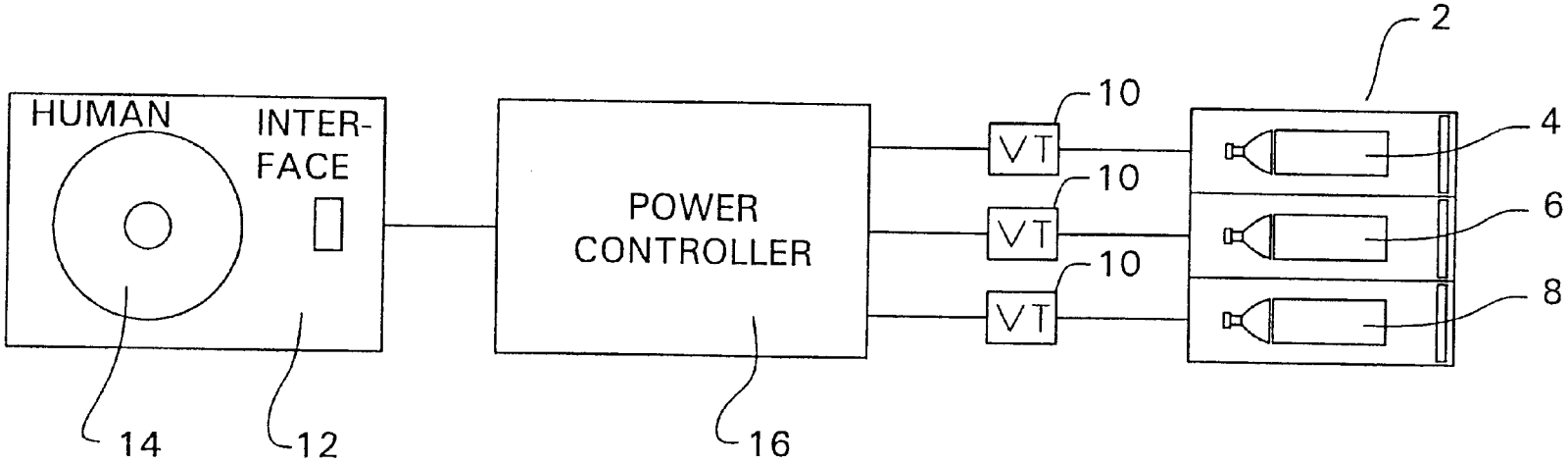
FIGS. 1 and 2 show schematic block diagrams of systems embodying the invention.

The schematic diagram of FIG. 1 shows a lighting unit 2 containing three light sources. A red source 4, a green source 6, and a blue source 8. Each of these is connected to a voltage transformer device 10 which supplies voltage to operate each of the light sources. The human interface 12 with a rotary knob 14 supplies control signals to a power controller 16 which in turn supplies power to the voltage transformers 10 in proportions dependent upon the position of the rotary knob 14. The human interface 12 is able to supply control signals to supply power to the voltage transformers 10 and thus to the light sources 4, 6, 8 in desired proportions so that any desired colour can be obtained.

Figure 2:
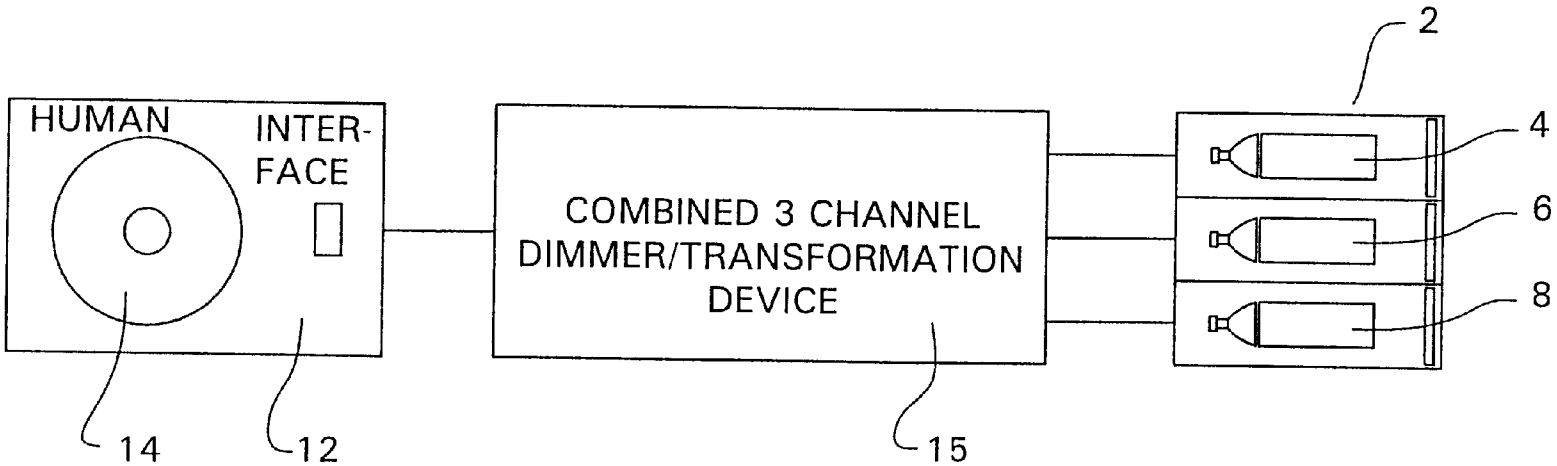

Alternatively in FIG. 2, the schematic diagram shows a lighting unit 2 containing three light sources, as above, which are connected to a three channel combined dimmer/transformer 15 which supplies power to operate each of the light sources. The human interface 12 with a rotary knob 14 supplies control signals direct to the transformation device 15 which in turn supplies power to the lamps in proportion dependent upon the position of rotary knob 14. The human interface 12 is able to supply control signals to supply power to the light sources 4, 6, 8 in desired proportions so that any desired colour can be obtained.

The light sources 4, 6 and 8 are positioned adjacent to each other and if a wider field of illumination is required then additional banks of red, green and blue light sources can be provided next to the lighting unit to give whatever width of illumination is required.

Figure 3:
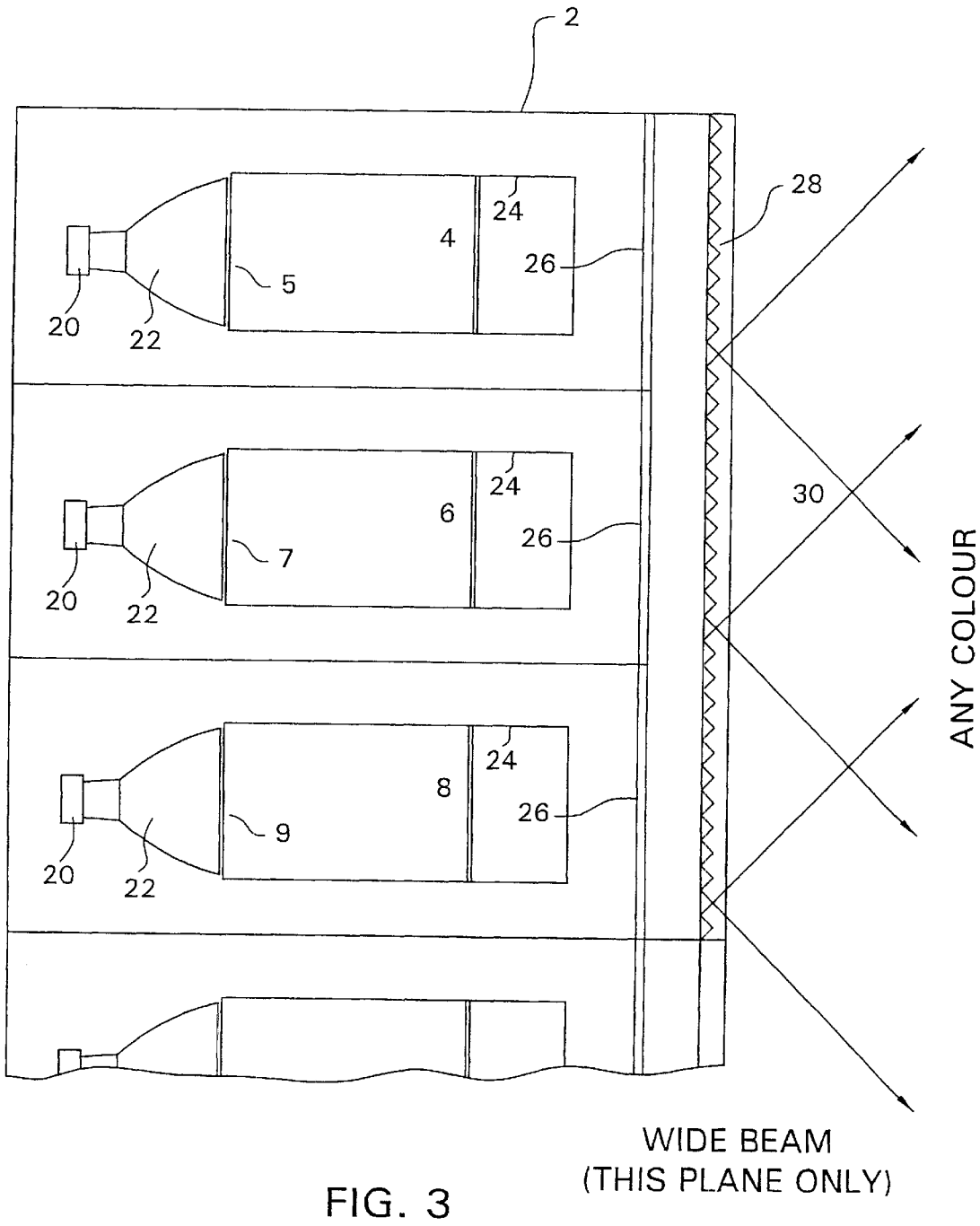
FIG. 3 is a schematic plan view of a lighting unit embodying the invention.

The lighting unit is illustrated in more detail in FIG. 3. Each of the light sources 4, 6 and 8 comprises a lamp 20 positioned at the end of a reflector 22 which reflects light through colour filters red 5, green 7, and blue 9 from the lamp into a columniation tube 24. The columniation tube focus the light into a substantially column-shaped beam. At the end of each columniation tube is a diffuser 26 which diffuses the light from the light sources and transmits it to a spread lens 28 which covers the whole of the front of the lighting unit. This comprises a set of parallel semi-specular or linear prismatic reflectors which are perpendicular to the plane of FIG. 3 and which cause the light to be diffused further up and down the plane of FIG. 3 as shown by the ray lines 30. As seen in this figure, the light is thus diffused in the plane along which the axes of the light beams emitted from the columniation tubes 24 are oriented. Thus, the lighting unit produces a wide beam up and down the plane of FIG. 3 whilst maintaining a narrow beam in a plane perpendicular to FIG. 3. This gives a very good mixing of the three colours and enables a surface such as a wall to be washed with the colour. This may be further enhanced by an auxiliary reflector of either semi-specular or prismatic material which further mixes the colour and turns the beam through an appropriate angle.

Figure 4:
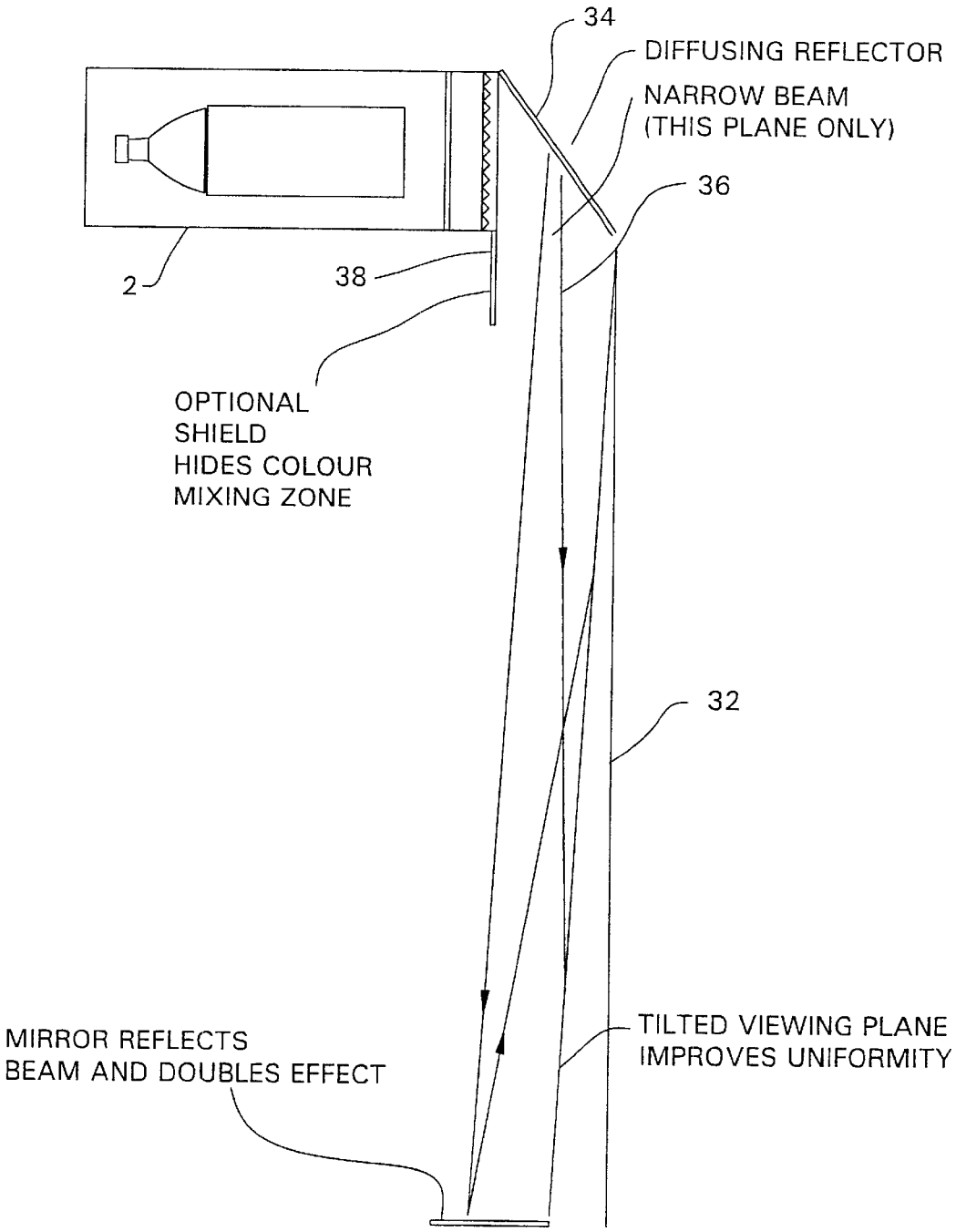
FIG. 4 is a side view of a lighting unit for use at the top of a wall to be illuminated.

FIG. 4 shows a side view of a unit in which the lighting unit 2 of FIG. 3 can be mounted. The unit is thus perpendicular to its position in FIG. 3 and the wide beam of the unit is therefore perpendicular to the plane of FIG. 4.

Usually unit 2 is mounted so that its primary direction of illumination is perpendicular to a wall 32. A reflector 34 reflects the narrow beam of mixed light 36 downwards onto the wall 32. A shield 38 is provided to stop a viewer seeing the mixing zone.

As can be seen, the wall 32 has its base inclined towards the viewing side. This improves the uniformity of illumination of the wall. Additionally, a mirror placed at the base of the wall will reflect the beam back up the wall and double the effect.

Alternatively, unit 2 can be mounted in the following positions relative to the wall with the noted different arrangements of lens and reflector and thus achieving the effects described as shown in FIGS. 6A to 6F.

1. Mounted to ceiling at an appropriate angle. Unit shall have linear refractor and no reflector achieving a soft spread of light to the ceiling (FIG. 6A).
2. Mounted in a ceiling at right angles to wall. Unit shall have a linear refractor lens and reflector 82 achieving a soft spread of coloured light on the wall (FIG. 6B).
3. Mounted to the ceiling at right angles to the floor using linear refractor and no reflector achieving a soft spread of light on the wall. Effect can be doubled by return mirror 80 (FIG. 6C).
4. Mounted from the ceiling at right angles to wall. Unit shall have a linear refractor lens and reflector 82 achieving a soft spread of coloured light on the wall. Effect can be doubled by return mirror 80 (FIG. 6D).
5. Mounted in the floor at right angles to wall. Unit shall have a linear refractor lens and reflector 82 achieving a soft spread of coloured light on the wall. Effect can be doubled by ceiling mounted return mirror 80 (FIG. 6E).
6. Mounted to the floor at right angles to ceiling, using linear refractor and no reflector achieving a soft spread of light on the wall and ceiling. Effect can be doubled by ceiling mounted return mirror 80 (FIG. 6F).
7. (Not shown) Mounted to ceiling at right angles to floor. Unit shall have diffuser and calumniating lens in place of linear refractor achieving a clearly defined circular area of light.

Figure 5:
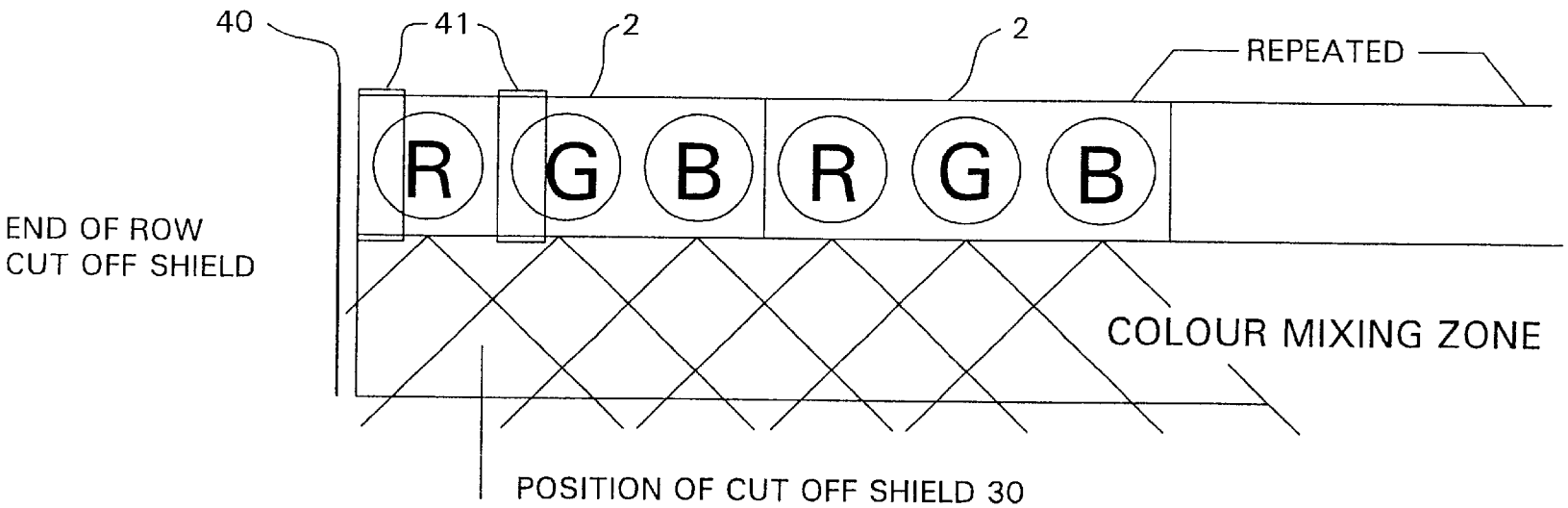
FIG. 5 is a front view of a similar unit.
Figure 6B:
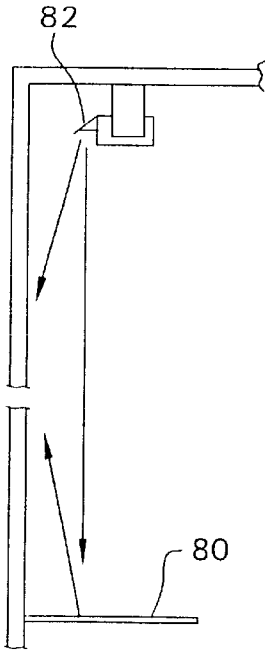
FIGS. 6A through 6F show a variety of mounting arrangements for the lighting unit.
Figure 6C:
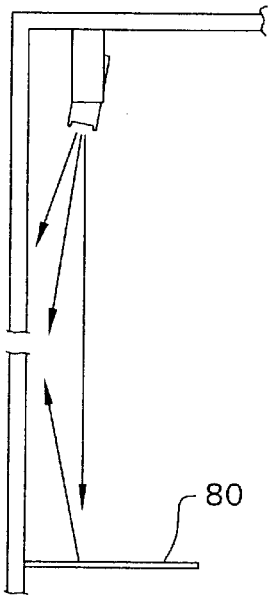
Figure 6D:
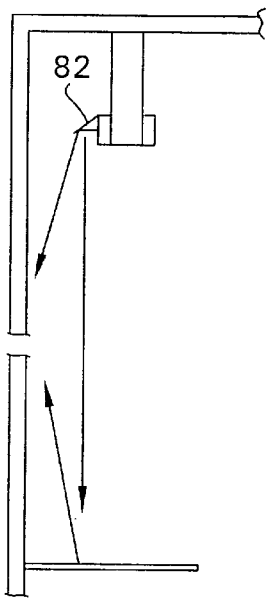
Figure 6E:
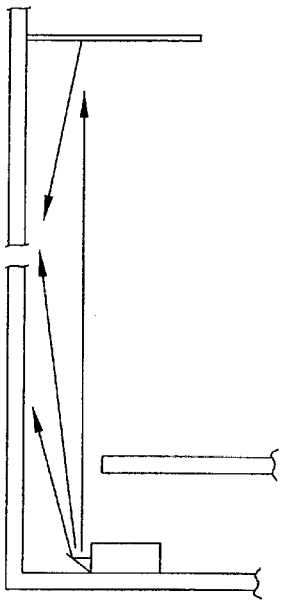
Figure 6F:
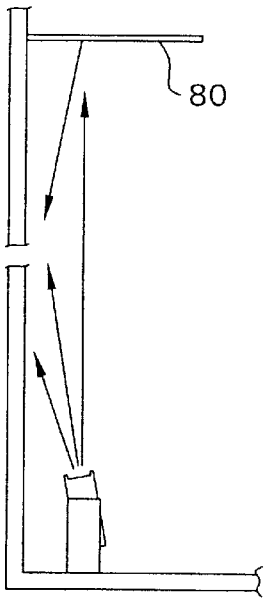
Figure 6A:
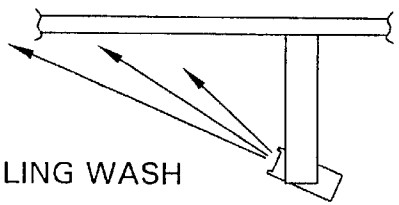

A front view of the lighting unit 2 is shown in FIG. 5. As can be seen the lighting unit is terminated by an end of unit cut-off shield 40 to prevent any light escaping to the side of the unit. The unit 2 is adjacent to a further unit 2 and additional units may be fixed adjacent to this according to the width of illumination required.

Using units as shown in FIG. 4 and FIG. 5 enables lighting units embodying the invention to be mounted within low height ceiling voids.

Alternatively, with a different arrangement of reflector and cut-off shields the unit could be mounted at the base of a wall shining light towards it.

The knob 14 on the human interface 12 is a single action knob and has a colour scale around it such that control sequences are sent to the power controller to send power to the voltage transformers 10 in desired proportions to ensure that a desired colour is produced by the lighting unit. This is intended to simplify the three separate controls which would usually be provided for the red, green and blue light sources.

The embodiment described above shows the use of red, green and blue light sources which will enable any colour in the spectrum to be produced with appropriate control signals. However, the invention could also be used with only two light sources, thus giving a narrower range of available colours.

Figure 7:
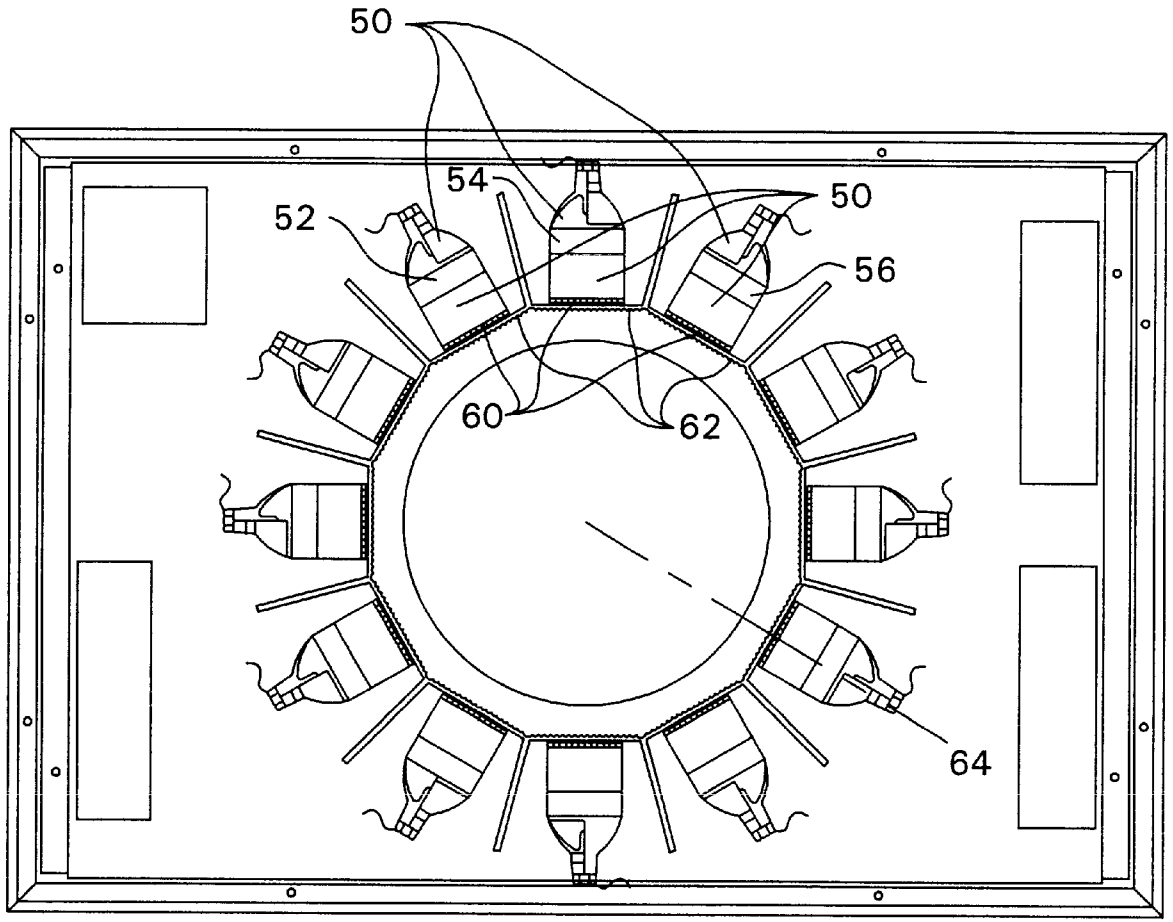
FIGS. 7 and 8 show plan and side views of an embodiment of the invention to be used behind e.g., a picture hung on the wall.
Figure 8:
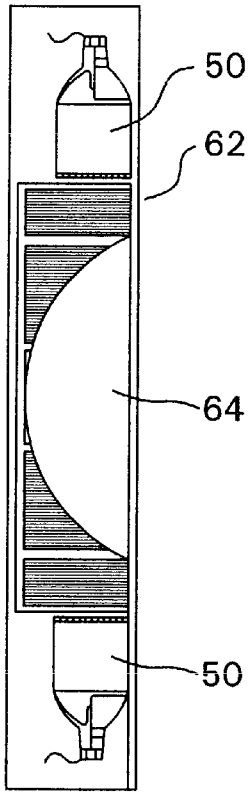

The unit need not be used to produce only a wash of light. Using a suitable arrangement of lenses, the unit could be used to produce e.g., a focused beam of light. Such an application is shown in FIGS. 7 and 8 which shows a diagram of the invention arranged as a "Picture Light" as it is mounted behind e.g., a picture hung on the wall.

Lamps 50, connected to transformers as described above, project a narrow beam of light through dichroic filters in red 52, green 54, and blue 56 this coloured light passes along tubes 58 and is diffused by diffuser 60 and spread by refractor 62, the three beams mix into a single colour with the help of a diffusing dome 64 which reflects and mixes the diffused light. The groups of three lamps and optical system are repeated around the dome 64 to form a continuous ring. The assembly is hung a small distance from a surface with the course surface of the dome towards the surface, and illuminates the surface with whatever colour the user sets with the control system described above. This happens as light is reflected and mixed by the course surface of the dome onto the surface to be illuminated.

What is claimed is:

1. A lighting system, said system comprising:

a plurality of light sources that are positioned adjacent each other and oriented to emit light in beams centered along parallel axes, each said light source being configured to emit a beam of light of a different color; and a spread lens located in front of said light sources, said spread lens configured to cause the light beams emitted by said light sources to widen along a first common plane so that the light beams mix in the first common plane while maintaining a narrow profile along a second common plane, the second common plane being substantially perpendicular to the first common plane.

2. The lighting system according to claim 1, wherein said spread lens comprises a set of parallel linear prismatic refractors.

3. The lighting system according to claim 2, wherein said spread lens comprises a plurality of parallel semi-specular elements.

4. The lighting system according to claim 1, further including a diffuser positioned between each said light source and the spread lens.

5. The lighting system according to claim 1 in which said light sources are arranged in a linear array.

6. The lighting system according to claim 1, in which said light sources are arranged in a circular array, each said light source pointing towards a center of the circle defined by the array.

7. The lighting system according to claim 6, in which the circular array surrounds a convex dome which mixes and reflects light from the sources onto a surface facing the convex surface of the dome.

8. The lighting system of claim 1, wherein each said light source further includes a separate, user-set intensity controller for regulating the intensity of the light beam emitted by said light source so that the color of light produced by the mixing of the emitted light beams is selectively regulated by regulating the light emitted from each said light source.

9. The lighting system of claim 8, further including a master regulator connected to each said light source intensity controller, said master regulator having a user-actuated color select controller, wherein said master regulator is configured to control the intensity of the light emitted by each said light source through said intensity controllers in response to the setting of said color select controller.

10. A lighting system according to claim 9, wherein said color select controller comprises a rotary knob.

11. The lighting system according to claim 9, wherein said color select controller comprises a slider.

12. The lighting system of claim 8, wherein a power supply is connected to each said light source to provide an individually selected amount of power to said light source to regulate the intensity of light emitted by said light source and said light source power supplies function as said light source intensity controllers.

13. The lighting source of claim 1, wherein:

said light sources are aligned so that the light beams emitted by said light sources along axes that are coplanar; and said spread lens is configured so that the first common plane, the plane along which the light beams are widened, is the plane along in which the axes of the light beams are located.

14. The lighting system of claim 1, further including a plurality of light sources that are configured to emit light of a first color and a plurality of light sources that are configured to emit light of a second color, the second color being different from the first color.

15. A lighting system, said lighting system comprising:

a plurality of light sources, each said light source comprising:

a light unit configured to emit a variable intensity light beam in response to an energization signal applied to said light unit; and an adjustable power supply for supplying a variable energization signal to said light unit; and a spread lens disposed in front of said light sources, said spread lens configured to receive the emitted beams of light and widen the beams in a first plane while the beams maintain narrow profiles in a second plane that is substantially perpendicular to the first plane, wherein said light units each emit a different color of light and said light units and said spread lens are arranged and configured so that said light units emit light beams that are wide along a first common plane to said light units so that the light beams mix in the first common plane to produce a mixed color output light and that are narrow in a second common plane to said light units, the second common plane being substantially perpendicular to the first common plane; and a control means connected to said light source power supplies for, in response to a user-entered command, regulating the energization signals supplied by said power supplies to cause the intensity of the light emitted by said light units to vary so as to regulate the color of the mixed color output light.

16. The lighting system of claim 15, wherein:

each said light unit includes a light emitting element;

the light emitted by each said light emitting element is applied to a separate columniation tube that focus the light emitted by said light emitting element into a substantially column shaped light beam that is centered around an axis, and said light units are arranged so that the axes along which the column-shaped light beams are emitted from said columniation tubes are in the first common plane; and said spread lens is positioned to receive the light beams emitted from said columniation tubes and said spread lens is oriented to cause the light beam emitted by each said columniation tube widen in the first common plane while maintaining a narrow profile in the second common plane.

17. The lighting system of claim 15, wherein said control means includes a single user-set control member that is set to establish the color of the output light and said control means is configured to regulate the energization signals supplied to said light units based on the setting of said user-set control member.

18. The lighting system of claim 15, further including a plurality of light sources that are configured to emit light of a first color and a plurality of light sources that are configured to emit light of a second color, the second color being different from the first color.

19. A lighting system comprising:

a plurality of light sources, each said light source having:

a light unit that emits a variable amount of light; and a focusing unit for receiving the light emitted by said light unit and forming the light into a substantially column shaped light beam that is centered along an axis wherein, said light sources are configured so that said light units emit light of different colors and said light sources are positioned so that light beams emitted from said focusing units are centered on axes that are in a first plane;

a spread lens configured to receive the light beams from said light units, said spread lens being configured to widen the light beams along the first plane so that the light beams mix along the first plane to produce an output light of mixed color and said spread lens is further configured so that the light beams emitted by said spread lens in a second plane are narrower than the beams emitted in the first plane, the second plane being substantially perpendicular to the first plane; and a single control unit attached to said light units for regulating the intensity of light emitted on a color-by-color basis by said light units so that, by regulating the intensity of the light emitted by said light units, said control unit establishes the color of the output light.

20. The lighting system of claim 19, wherein:

each said light unit includes a light emitting element and an adjustable power supply that is connected to said light emitting element to apply a variable energization signal to said light emitting element to regulate the intensity of light emitted by said light emitting element; and said control unit is connected to said adjustable power supplies for establishing the level of the energization signals applied by said power supplies to said light units.

21. The lighting system of claim 19, further including a plurality of light sources each with a light unit that emits light of a single first color and a plurality of light sources each with a light unit that emits light of a single second color that is different from the first color.

* * * * *